US010133239B2

(12) United States Patent
Yi

(10) Patent No.: US 10,133,239 B2
(45) Date of Patent: Nov. 20, 2018

(54) DISPLAY DEVICE HAVING AUTOMATICALLY ALIGNED DISPLAY UNIT

(71) Applicant: Ji Ha Yi, Seoul (KR)

(72) Inventor: Ji Ha Yi, Seoul (KR)

( * ) Notice: Subject to any disclaimer, the term of this patent is extended or adjusted under 35 U.S.C. 154(b) by 0 days.

(21) Appl. No.: 15/328,311

(22) PCT Filed: Jul. 22, 2015

(86) PCT No.: PCT/KR2015/007651

§ 371 (c)(1),
(2) Date: Jan. 23, 2017

(87) PCT Pub. No.: WO2016/013879

PCT Pub. Date: Jan. 28, 2016

(65) Prior Publication Data

US 2017/0220003 A1 Aug. 3, 2017

(30) Foreign Application Priority Data

Jul. 22, 2014 (KR) ..... 10-2014-0092460

(51) Int. Cl.
*G04B 19/28* (2006.01)

(52) U.S. Cl.
CPC ..... *G04B 19/28* (2013.01)

(58) Field of Classification Search
CPC ..... G03H 1/2294; G03H 1/265; G03H 1/08; G03H 1/2202; G03H 2223/23; G03H 2225/12; G03H 2001/2239; G04B 19/28
(Continued)

(56) References Cited

U.S. PATENT DOCUMENTS 6,643,223 B2 * 11/2003 Fujisawa ..... G04G 19/08 307/116
8,902,716 B2 * 12/2014 Maruyama ..... G04R 60/12 368/293

(Continued)

FOREIGN PATENT DOCUMENTS

CN 1514957 A 7/2004
CN 102402176 A 4/2012

(Continued)

OTHER PUBLICATIONS

International Search Report for PCT/KR2015/007651 dated Nov. 24, 2015 from Korean Intellectual Property Office.

(Continued)

*Primary Examiner* — Edwin A. Leon
(74) *Attorney, Agent, or Firm* — Paratus Law Group, PLLC

(57) ABSTRACT

The present invention relates to a display device having a rotatable display unit (12), the display device including: a display main body (10) having the display unit (12) for displaying various items of information; a rotary unit (20) combined with the display main body (10) and having a rotary weight (25) eccentric from the display main body (10); and a rotary base (30) combined with the display main body (10) or the rotary unit (20) to rotate relative to the display main body (10) or the rotary unit (20), in which the rotary unit (20) and the display main body (10) combined with the rotary unit (20) are rotated relative to the rotary base (30) and aligned in a predetermined direction by gravity acting on the rotary weight (25).

18 Claims, 12 Drawing Sheets

(58) Field of Classification Search
USPC ..... 368/223
See application file for complete search history.

(56) References Cited

U.S. PATENT DOCUMENTS

| | | | | |
|---|---|---|---|---|
| 2004/0004909 | A1 | 1/2004 | Fujimori | |
| 2004/0090868 | A1* | 5/2004 | Endo | G04G 21/04 368/10 |
| 2004/0105347 | A1* | 6/2004 | Fujimori | G04C 3/008 368/293 |
| 2004/0233794 | A1* | 11/2004 | Maruyama | G04C 3/12 368/157 |

FOREIGN PATENT DOCUMENTS

| | | | |
|---|---|---|---|
| FR | 2705470 | A | 11/1994 |
| GB | 2176044 | A | 12/1986 |
| JP | 09-015345 | A | 1/1997 |
| KR | 20-0243671 | Y1 | 10/2001 |
| KR | 20-0266907 | Y1 | 3/2002 |
| KR | 10-0605775 | B1 | 7/2006 |
| KR | 10-2010-0073582 | A | 7/2010 |

OTHER PUBLICATIONS

Extended Search Report for European Patent Application No. 15824373.3 dated Feb. 27, 2018 from European Patent Office.
Chinese Office Action for related CN application No. 201580041029.7 dated Jul. 30, 2018 from Chinese Patent Office.

* cited by examiner

【FIG. 7A】
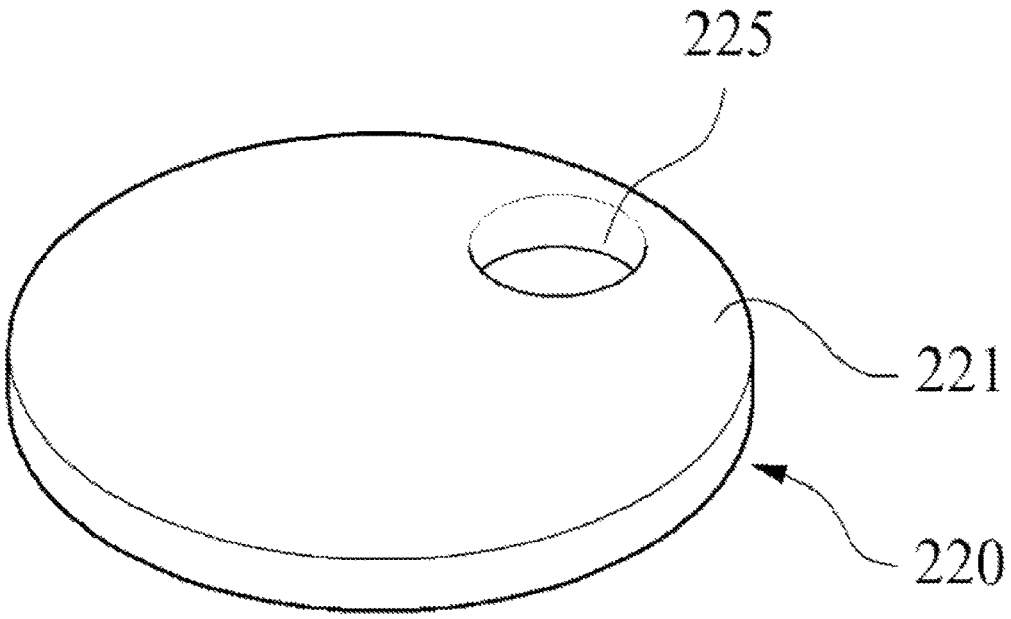
【FIG. 7B】
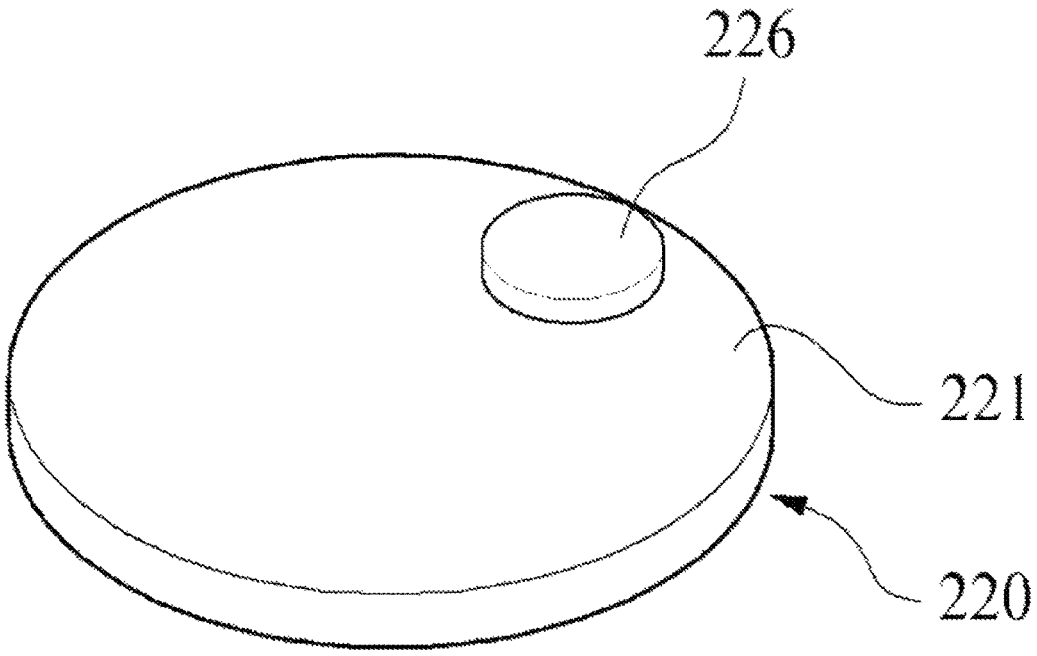

DISPLAY DEVICE HAVING AUTOMATICALLY ALIGNED DISPLAY UNIT

CROSS REFERENCE TO PRIOR APPLICATIONS

This application is a National Stage Patent Application of PCT International Patent Application No. PCT/KR2015/007651 (filed on Jul. 22, 2015) under 35 U.S.C. § 371, which claims priority to Korean Patent Application No. 10-2014-0092460 (filed on Jul. 22, 2014), which are all hereby incorporated by reference in their entirety.

TECHNICAL FIELD

The present invention relates to a display device and, more particularly, to a display device in which a display unit for showing time and other information is rotated and aligned to a predetermined direction by gravity.

BACKGROUND ART

Clocks are instruments that show time on a display unit and are provided in various types depending on the uses and purposes, and examples include a wristwatch, a wall clock, and a table clock. Further, there are not only analog clocks having an hour hand and a minute hand, but electronic clocks showing hour/minute/second by displaying numbers.

When using these various clocks, users generally have to appropriately align the angles of their eyes and the display unit in order to easily check time. For example, as for a watch, as shown in FIG. 1, a user needs to turns his/her wrist at an appropriate angle in order to check time. Further, wall clocks needs to be installed with the display unit accurately aligned for a user to easily check time.

Accordingly, if a display unit is automatically aligned at an angle without a user adjusting the angle of the display unit every time he/she checks time, it would be considerably easier to check time.

DISCLOSURE

Technical Problem

The present invention has been made in an effort to solve the problems in the related art and an object of the present invention is to automatically appropriately align an angle of a display unit in the display main body of a display device.

Another object of the present invention is to the display main body of a display device to be automatically supplied or charged with power by rotation of a display unit.

Technical Solution

According to an aspect for achieving the object of the present invention, a display device includes: a display main body having a display unit for displaying time; a rotary unit combined with the display main body and having a rotary weight eccentric from the display main body; and a rotary base combined with the display main body or the rotary unit to rotate relative to the display main body or the rotary unit, in which the rotary unit and the display main body combined with the rotary unit are rotated relative to the rotary base and aligned in a predetermined direction by gravity acting on the rotary weight.

The rotary unit may include a rotary plate coupled to a rear side of the display main body and a rotary weight coupled to the rotary plate to be eccentric from a center of gravity of the display main body.

The rotary base may include a base plate disposed on a rear side of the display main body and a side housing extending from an edge of the base plate and surrounding the rotary unit.

A stopper may be formed on at least any one of the rotary unit, the display main body, and the rotary base and may stop rotation of the rotary unit and the display main body combined with the rotary unit.

The rotary base may have a rotary shaft, the display main body or the rotary unit may be rotatably coupled to the rotary shaft, and the rotary unit and the display main body combined with the rotary unit may be rotated about the rotary shaft.

The display main body or the rotary base combined with the display main body may have a rotary shaft, the rotary unit may be rotatably coupled to the rotary shaft to rotate relative to the rotary base, and the rotary unit and the display main body combined with the rotary unit may be rotated about the rotary shaft.

The rotary shaft may have a body coupled to the display main body or the rotary unit and a head formed at an end of the body and having a lateral cross-section larger than that of the body, and the body and the head are covered with a cover detachably coupled to the rotary base.

A bearing fitted around the rotary shaft may be disposed between the display main body and the rotary base.

The bearing may be disposed in a space defined by a depression formed toward the display main body on the rotary base, a cover detachably coupled to the rotary base, and the rotary shaft.

A power generator may be disposed around the rotary shaft between the display main body and the rotary base and may generate electricity from rotation of the rotary shaft.

A rotational rib and a rotational slot corresponding to each other are formed respectively on a side housing of the rotary base and on the outer side, which is in contact with the side housing, of the rotary unit so that the rotary base and the rotary unit are relatively rotated by the rotational rib and the rotational slot.

The rotary weight is detachably coupled to the rotary unit.

According to another aspect of the present invention, a display device includes: a display main body having a display unit for displaying information; a rotary weight eccentrically disposed on the display main body; and a rotary base combined with the display main body to rotate relative to the display main body, in which the display main body is rotated relative to the rotary base and aligned in a predetermined direction by gravity acting on the rotary weight.

ADVANTAGEOUS EFFECTS

According to the display device having an automatically aligned display unit of the present invention, the following effects can be expected.

According to the present invention, since the display unit is always aligned in the direction of gravity by the rotary weight, a user does not need to adjust the display device to an appropriate angle every time in order to check various items of information including time, thereby considerably increasing convenience in use of the display device.

Further, since a small power generator is disposed in the display device and generates electricity by being rotated by torque of the display unit, whereby it can supply power to the display device. Accordingly, efficiency of the display device is improved.

DESCRIPTION OF DRAWINGS

FIGS. 7(*a*) and 7(*b*) are perspective views showing the configuration of other embodiments of the present invention.

MODE FOR INVENTION

Detailed embodiments of a display device having an automatically aligned display unit of the present invention are described hereafter in detail with reference to the accompanying drawings.

A wristwatch of display devices is exemplified in the following description.

Figure 1:
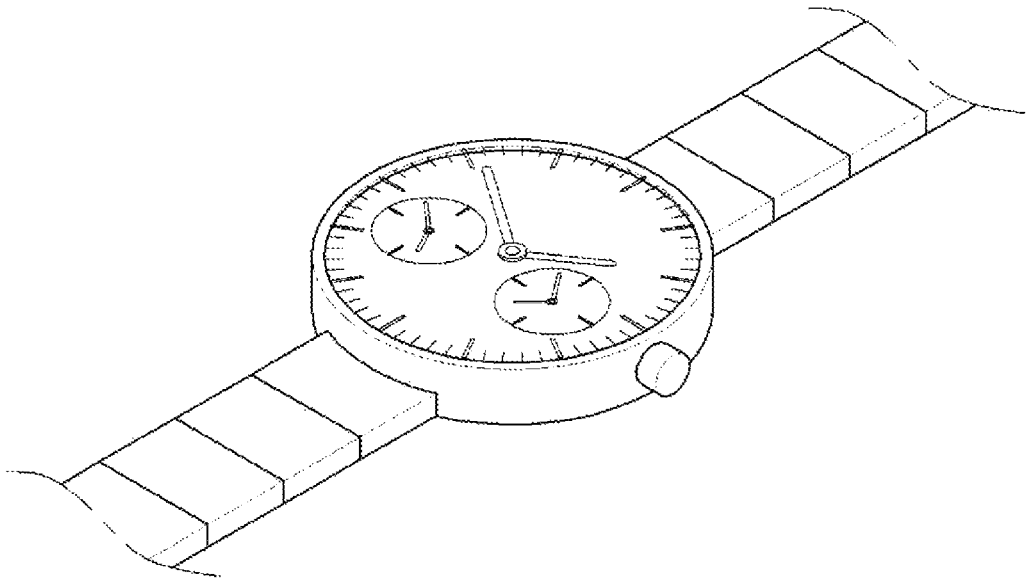
FIG. 1 is a perspective view showing a common wristwatch.
Figure 2:
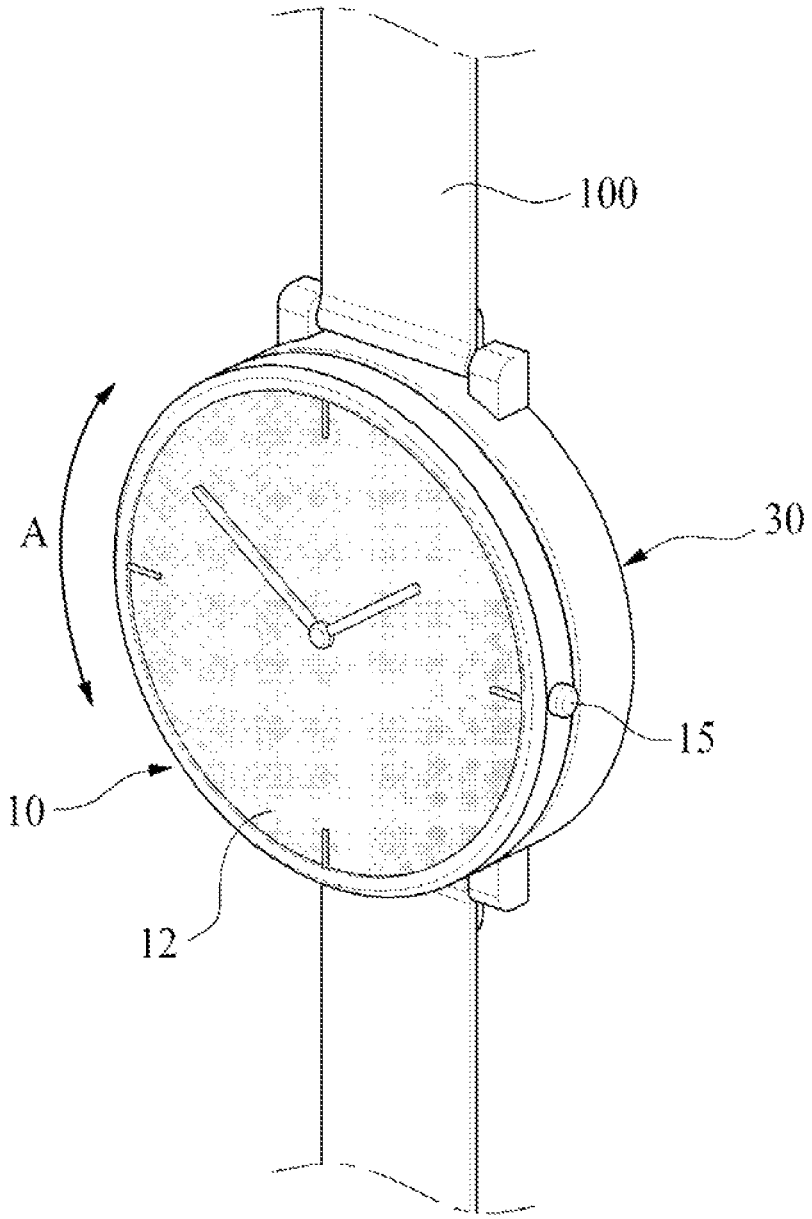
FIG. 2 is a perspective view showing the configuration of a first embodiment of a display device having an automatically aligned display unit of the present invention.
Figure 3:
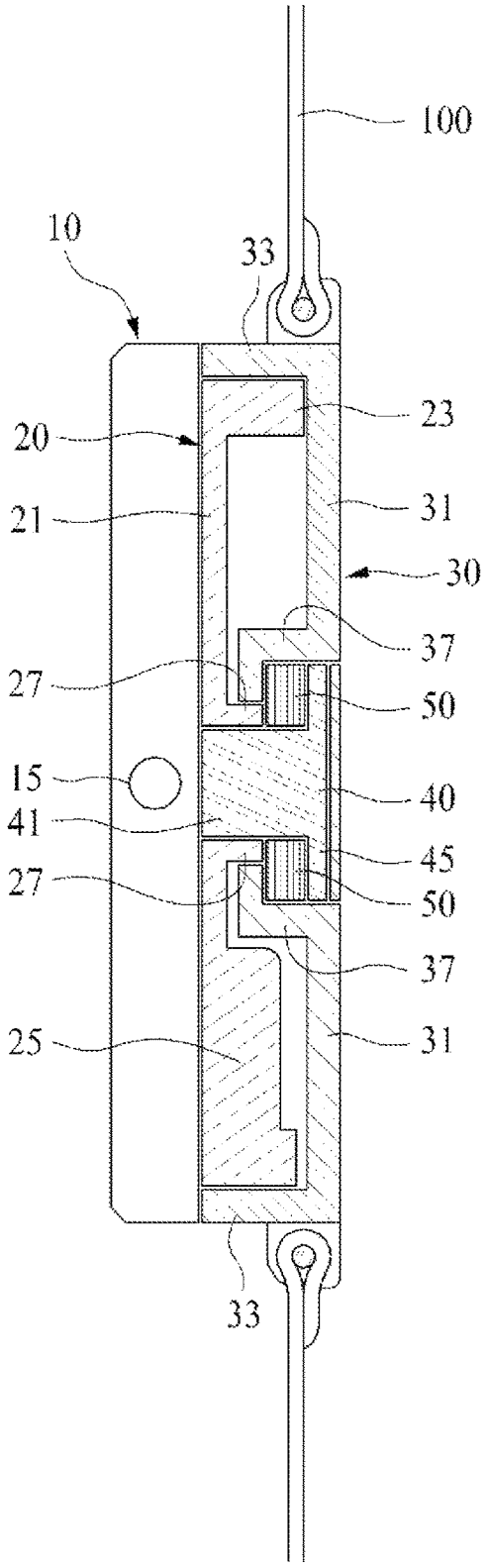
FIG. 3 is a cross-sectional view showing the configuration of the embodiment of the present invention.

FIG. 2 is a perspective view showing the configuration of an embodiment of a display device having an automatically aligned display unit of the present invention and FIG. 3 is a cross-sectional view showing the configuration of the embodiment of the present invention.

Referring to the figures, a display device having an automatically aligned display unit of the present invention includes a display main body 10, a rotary unit 20, and a rotary base 30.

Of these parts, first, the display main body 10, which is a part that actually shows the time through a display unit 12, has an operation mechanism therein for operating the watch. The display unit 12 may be composed of an hour hand and a minute hand or may be an electronic display unit 12 showing hour/minute/second by displaying numbers. Reference numeral '15' indicates a working knob for operating the watch.

The rotary unit 20 is combined with the display main body 10. The rotary unit 20, which is a part combined with the display main body 10 to rotate with the display main body 20, has a rotary weight 25 to be further influenced by gravity.

In detail, the rotary unit 20 is a part coupled to the rear side of the display main body 10, having the rotary weight 25, and being rotated with the display main body 10 by gravity. As shown in FIG. 3, the rotary unit 20 includes a rotary plate 21 coupled to the rear side of the display main body 10 and the rotary weight 25 coupled to the rotary plate 21.

The rotary plate 21 is formed in a thin plate shape corresponding to the display main body 10 and coupled to the rear side of the display main body 10 and the rotary weight 25 is coupled to the outer side of the rotary plate 21.

The rotary weight 25 is disposed on the rotary plate 21 eccentrically from the center of gravity of the display main body 10. This is for aligning the display main body 10 and the rotary unit 20 in a predetermined direction (gravity direction) by gravity acting on the rotary weight 25. In this embodiment, the rotary weight 25 is disposed at the lower portion of the display unit 12 of the display main body 10, that is, on the six o'clock.

Obviously, the rotary weight 25 may be fixed not on at the six o'clock, but at various positions in consideration of the structure or convenience of the display unit.

The rotary weight 25 may be made of a high-density material, so the rotary weight 25 is made of metal and detachably attached to the rotary unit 20 in this embodiment. Accordingly, it may be possible to remove the rotational effect by separating the rotary weight 25, if necessary, or it may be possible to achieve a higher rotational effect by replacing the rotary weight 25 with a heavier rotary weight 25.

A side guide 23 is disposed around the outer edge of the rotary plate 21 of the rotary unit 20. The side guide 23 that is a part being in contact with a side housing 33 of the rotary base 30 to be described below is continuously formed around the outer edge of the rotary plate 21.

Alternatively, FIGS. 7(*a*) and 7(*b*) show a rotary plate 221 according to anther embodiment. The rotary plate 221, as shown in the figure, may be formed in a thin plate shape. A rotary weight 226 may be disposed on the rotary plate 221 so that the center of gravity is eccentric (FIG. 7(*b*)) or an eccentric hole 225 may be formed through the rotary plate 221 so that the center of gravity is eccentric.

The rotary plate 221 of the rotary unit 20 may be coupled to the rear side of the display main body 10 or may be integrally formed with the display body 10 and the rotary weight 226 may be a magnet to be combined with the rotary plate 221 by magnetic force.

The rotary base 30 is coupled to the rear side of the display main body 10 with the rotary unit 20 therebetween. The rotary base 30 is combined with the display main body 10 or the rotary unit 20 for relative rotation and keeps fixed when the display main body 10 and the rotary unit 20 rotate. For example, as for a wristwatch, the rotary base 30 is a part that comes in contact with a user's wrist and straps 100 that are wound around the wrist are connected to the rotary base 30.

As shown in FIG. 3, the rotary base 30 includes a base plate 31 disposed on the rear side of the display main body 10 and a side housing 33 extending from the edge of the base plate 31 and surrounding the rotary unit 20. That is, the rotary base 30 covers the rotary unit 20 so that the rotary unit 20 is not exposed to the outside.

Meanwhile, the rotary base 30, the rotary unit 20, or the display main body 10 may have a rotary shaft 40. The rotary shaft 40 is the rotational center of the rotary unit 20 and the display main body 10 combined with the rotary unit 20 and may be fixed to the rotary base 30 or may be combined with the rotary unit 20 (or the display main body 10).

First, when the rotary base 30 has the rotary shaft 40, the rotary shaft 40 is fixed without rotating and the display main body 10 or the rotary unit 20 is rotatably fitted on the rotary shaft 40, so the rotary unit 20 and the display main body 10 combined with the rotary unit 20 are rotated about the rotary shaft 40. For reference, the rotary shaft 40 is fixed to the rotary base 30 in FIG. 3.

The rotary shaft 40 has a body 41 coupled to the display main body 10 or the rotary unit 20 and a head 45 formed at an end of the body 41 and having a lateral cross-section area larger than that of the body 41. The body 41 and the head 45 are covered with a cover unit (not given a reference number) detachably coupled to the rotary base 30.

Figure 4:
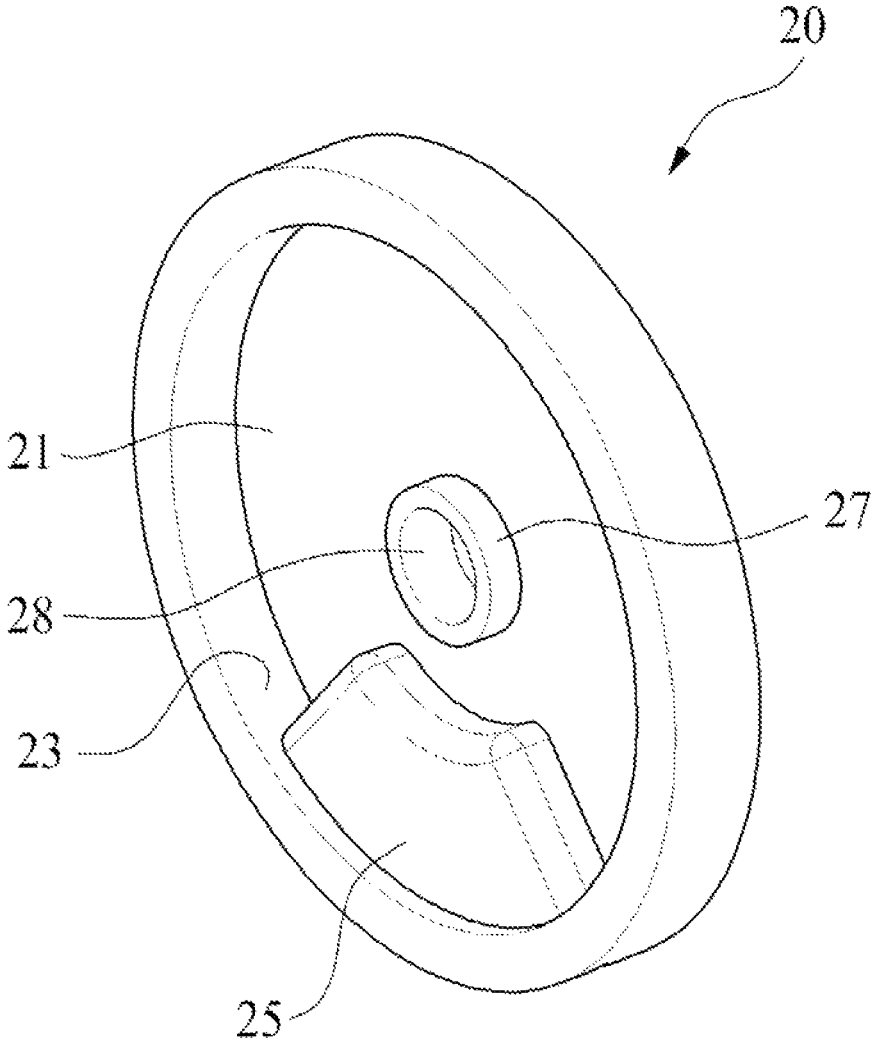
FIG. 4 is a perspective view showing the configuration of a rotary unit of the present invention.

As shown in FIG. 4, a coupling hole 28 for coupling the rotary shaft 40 is formed at the center of the rotary unit 20, and the coupling hole 28 may be formed at a projective guide 27 on the rotary unit 20. The projective guide 27 allows more stable rotation by increasing the contact area with the rotary shaft 40 (or a bearing 50 to be described below).

On the other hand, the display main body 10 or the rotary unit 20 combined with display main body 10 may have the rotary shaft 40, in which the rotary shaft 40 may be fitted to the rotary base 30 for relative rotation, and the rotary unit 20 and the display main body 10 combined with the rotary unit 20 may rotate about the rotary shaft 40.

Figure 5:
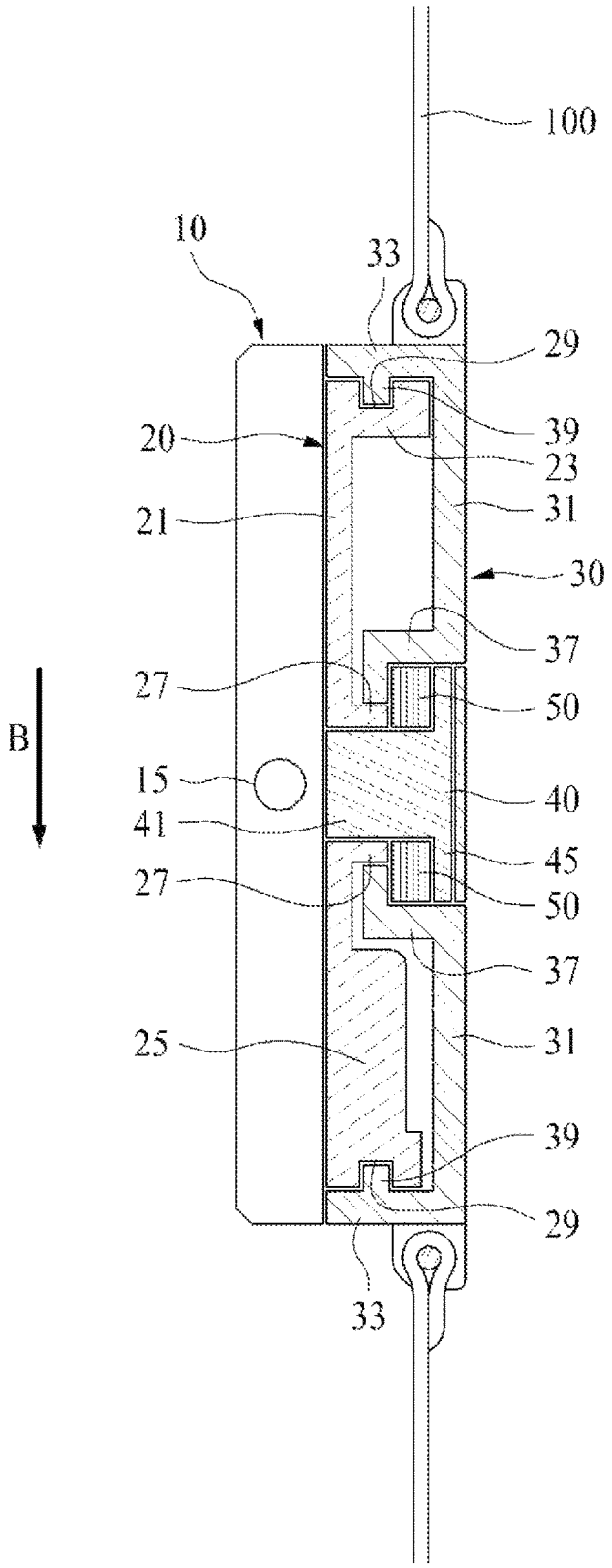
FIG. 5 is a cross-sectional view showing the configuration of a second embodiment of a display device having an automatically aligned display unit of the present invention.
Figure 6:
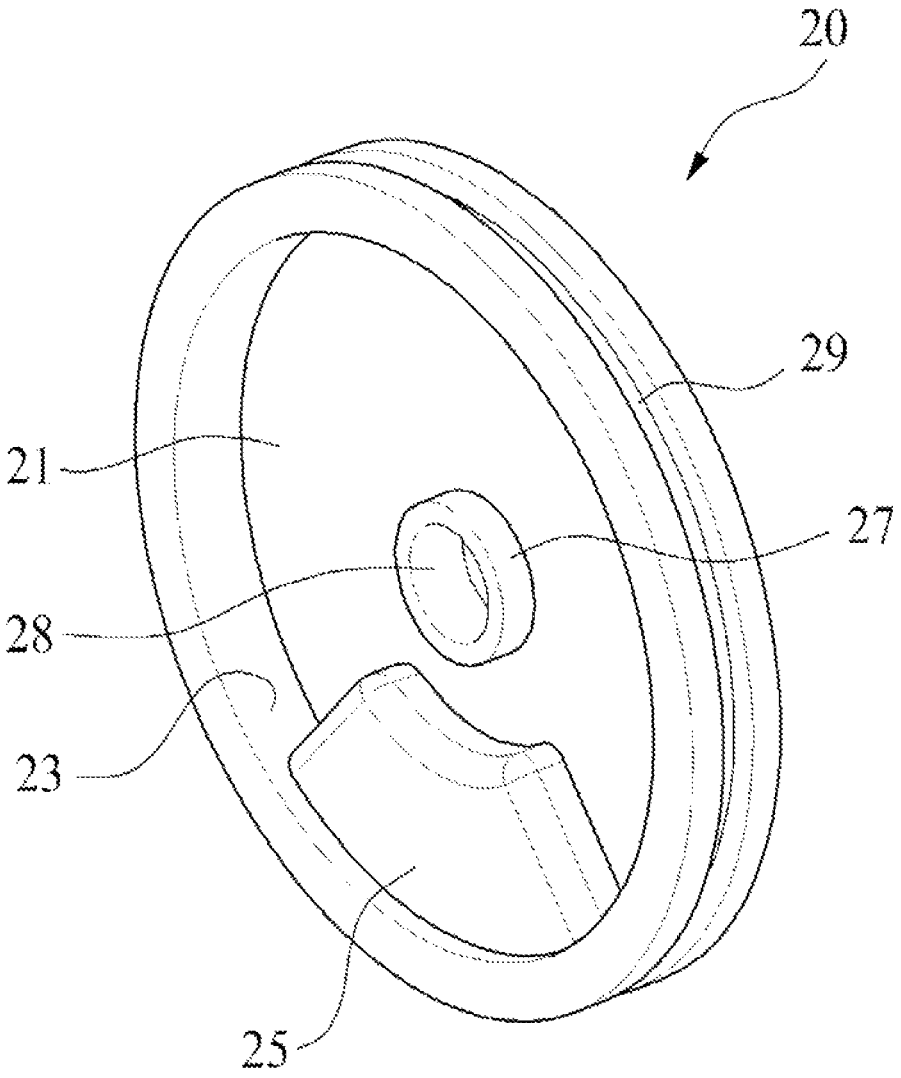
FIG. 6 is a perspective view showing the configuration of a rotary unit in the second embodiment of the present invention shown in FIG. 5.

Obviously, the rotary shaft 40 may not be provided, that is, for example, as in the second embodiment shown in FIGS. 5 and 6, a rotational rib 39 and a rotational slot 29 corresponding to each other may be formed respectively on the side housing 33 of the rotary base 30 and on the outer side, which is in contact with the side housing 33, of the side guide 23 of the rotary unit 20 so that the rotary base 30 and the rotary unit 20 may be relatively rotated by the rotational rib 29 and the rotational slot 39.

Meanwhile, the bearing 50 is fitted on the rotary shaft 40 between the display main body 10 and the rotary base 30. The bearing 50 is a rolling bearing 50 that is fitted around the rotary shaft 40 and allows the rotary unit 20 and the display main body 10 combined with the rotary unit 20 to more smoothly rotate relative to the rotary base 30.

Figure 9:
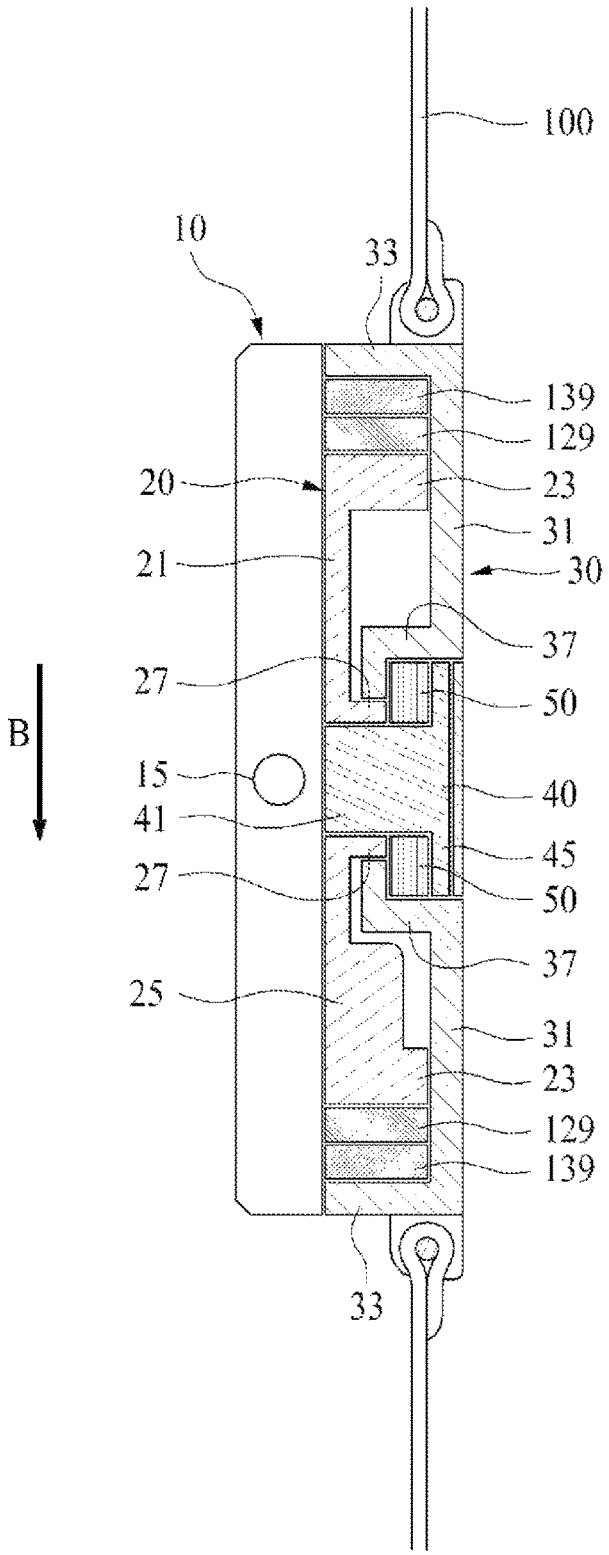
FIG. 9 is a cross-sectional view showing the configuration of a fourth embodiment of a display device having an automatically aligned display unit of the present invention.

Other than the bearing 50, a separate bearing 129, 139 may be provided. As shown in FIG. 9, the bearing 129, 139 may be disposed between the rotary unit 20 and the rotary base 30 such that the inner race 129 and the outer race 139 are rotated in contact with the rotary unit 20 and the rotary base 30, respectively, so the display main body 10 and the rotary base 30 can rotate relative to each other. That is, the rotary shaft 40 is shown in FIG. 9, but the rotary shaft 40 may be removed. Further, the rotary unit 20 may be removed and the bearing 129, 139 may be disposed between the display main body 10 and the rotary base 30.

Further, though not shown in the figures, a stopper may be formed on at least any one of the rotary unit 20, the display main body 10, and the rotary base 30 to stop rotation of the rotary unit 20 and the display main body 10 combined with the rotary unit 20. The stopper may selectively protrude at the joint between the rotary unit 20 and the rotary base 30 to stop relative rotation between them.

As shown in FIG. 3, the bearing 50 is disposed in a space defined by a depression formed toward the display main body 10 on the rotary base 30, the cover detachably coupled to the rotary base 30, and the rotary shaft 40.

Meanwhile, though not shown in the figures, a power generator may be disposed around the rotary shaft 40 between the display main body 10 and the rotary base 30, instead of the baring 50. The power generator, which is a part for generating electricity from rotation of the rotary shaft 40, supplies power for operating the display main body 10 by converting torque into electricity.

Figure 10:
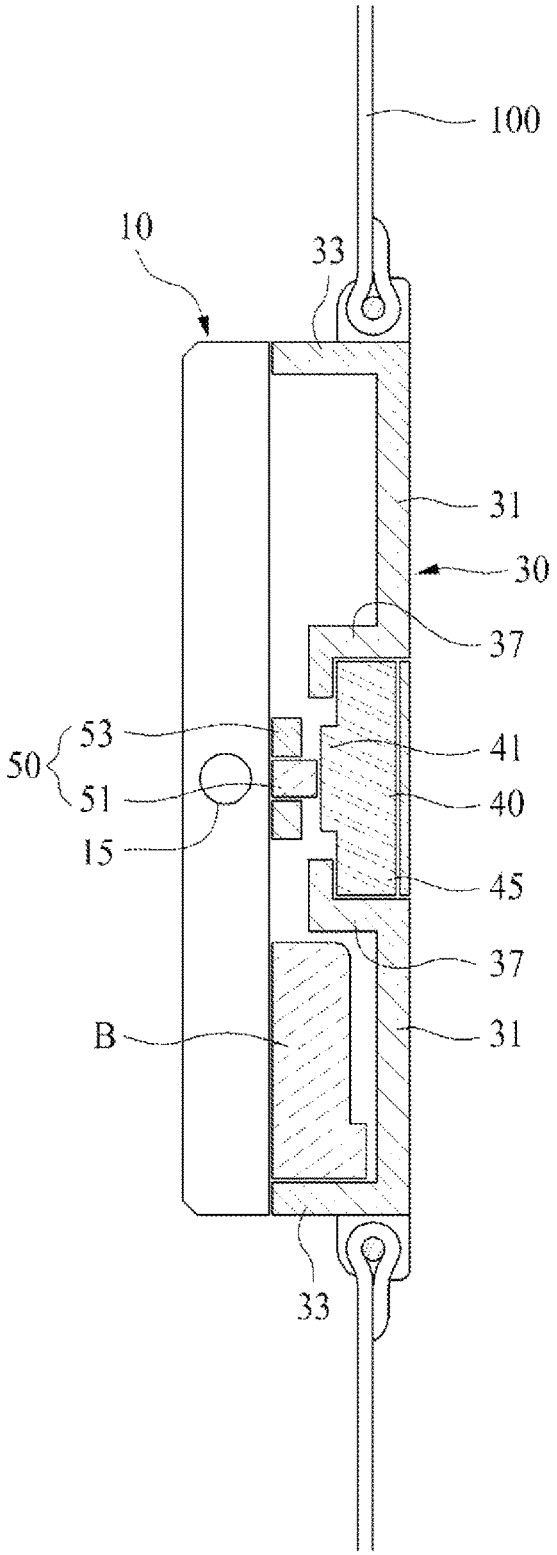
FIG. 10 is a cross-sectional view showing the configuration of a fifth embodiment of a display device having an automatically aligned display unit of the present invention.

Further, as shown in FIG. 10, the power generator 50 may be composed of a power generation shaft 51 and a power generation unit disposed around the power generation shaft 51 to generate electricity using relative rotation of them. In detail, the power generation shaft 51 is fixed to and in contact with the rotary shaft 40 and the power generation unit 53 fixed to the display main body 10 rotates relative to the power generation shaft 51 by rotating with the display main body 10.

Further, a storage unit B may be connected to the power generator 50 to keep power and the kept power may be transmitted to the outside through a separate external terminal (not shown).

Further, as shown in FIG. 10, the rotary unit 20 may be removed and the storage unit B may be combined with the display main body 10 to function as a rotary weight in this embodiment. Further, the power generator 50 and the storage unit B may protrude on the rear side of the display main body 10, as shown in FIG. 10, or may be disposed in the display main body.

Figure 8:
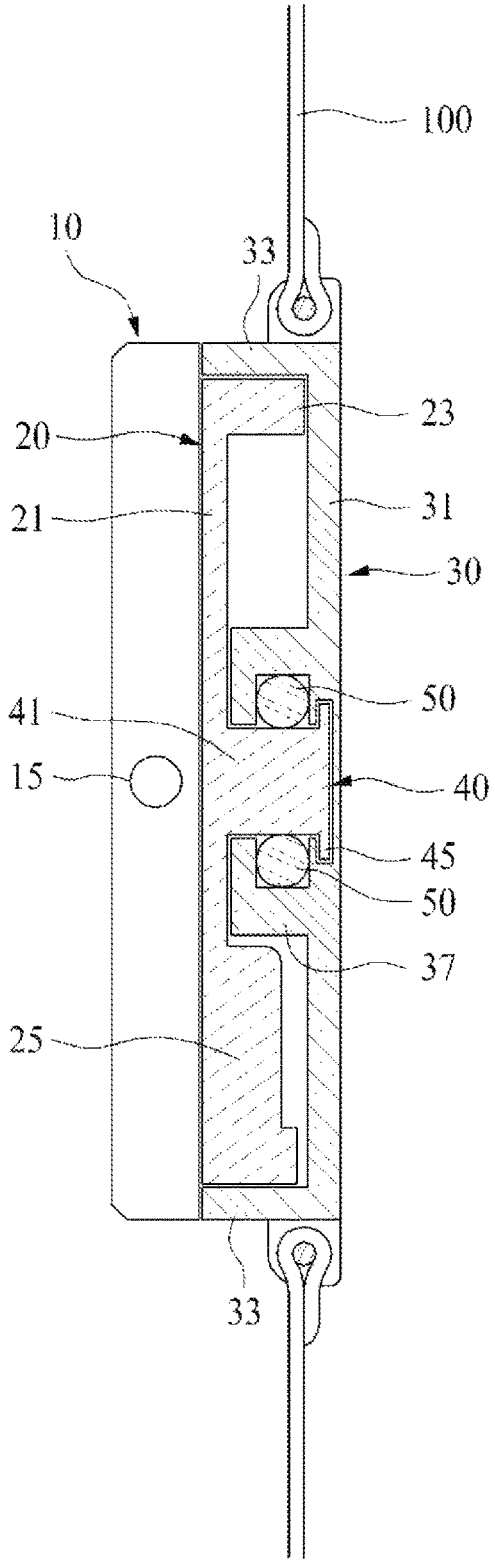
FIG. 8 is a cross-sectional view showing the configuration of a third embodiment of a display device having an automatically aligned display unit of the present invention.

Further, as shown in FIG. 8, the rotary shaft 40 may be integrally formed with the rotary unit 20 and the rotary base 30 may be coupled to the rotary shaft 40 to rotate with the rotary shaft.

The operation of the display device having an automatically aligned unit according to the present invention is described in detail hereafter.

First, when a user put the watch having the rotatable display unit 21 of the present invention on his/her wrist, the display main body 10 is exposed to the outside and the rotary base 30 is in contact with the user's wrist.

When the user shakes or turns his/her wrist, the rotary unit 20 and the display main body 10 are rotated by the gravity acting on the rotary weight 25 of the rotary unit 20 combined with the display main body 10.

In detail, the rotary unit 20 and the display main body 10 combined with the rotary unit 20 are rotated relative to the rotary base 30 and aligned in a predetermined direction by the gravity acting on the rotary weight 25. The alignment direction is the direction in which the direction of the gravity and the virtual line connecting the twelve o'clock and the six o'clock of the display unit 12 coincide with each other.

Accordingly, the user sees the display unit 12 aligned in the direction of gravity regardless of the angle of the wrist, so he/she can more easily check the time.

Figure 11:
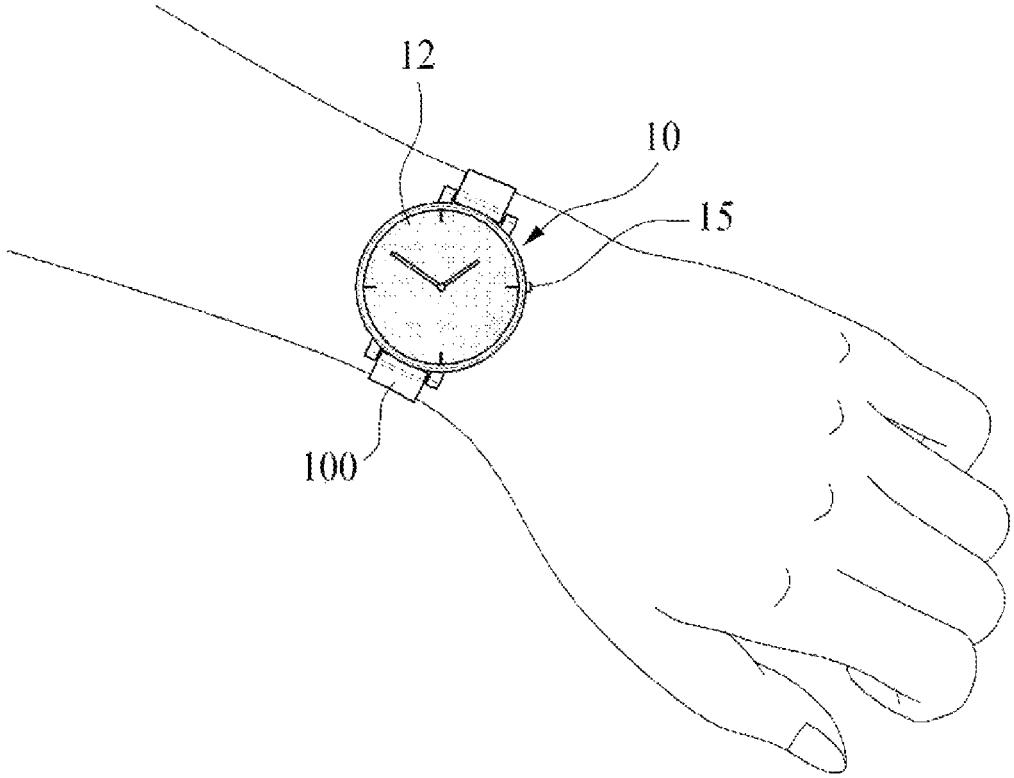
FIGS. 11 and 12 are exemplary views when a user wears a display device having an automatically aligned display unit of the present invention.
Figure 12:
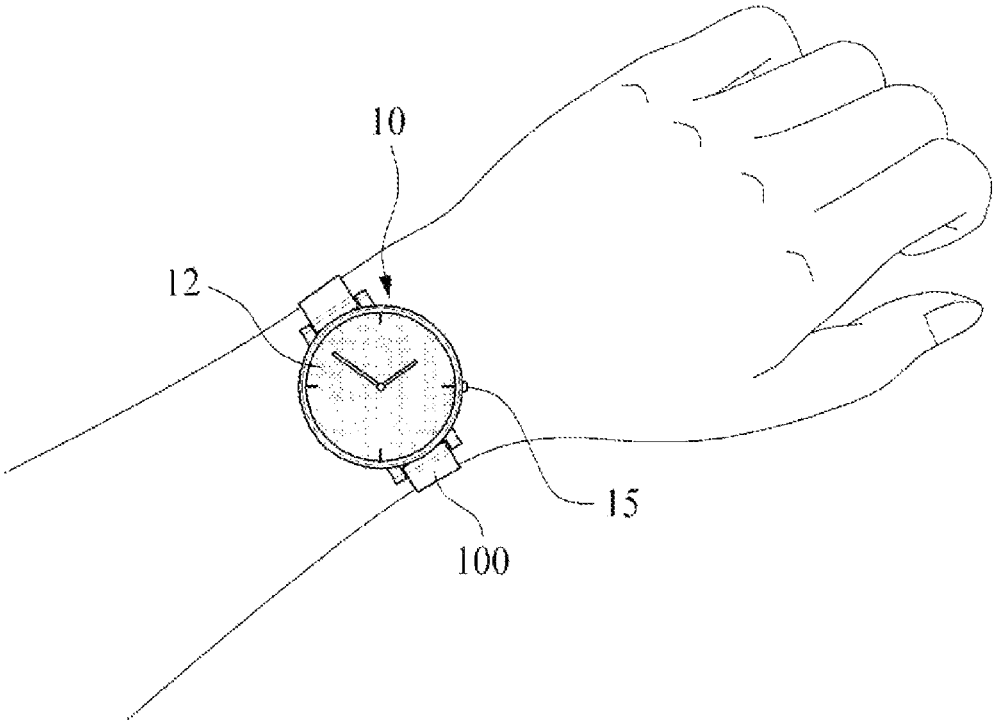

This situation is shown in FIGS. 11 and 12. FIGS. 11 and 12 show an exemplary view when a user wears the watch having the rotatable display unit 12 of the present invention. As shown in the figures, the display unit 12 keeps aligned in a predetermined direction, that is, the direction of gravity regardless of the angle of the user's wrist.

Further, when the power generator is operated while the display unit 12 and the rotary unit 20 are rotated, it generates and supplies power to the display main body 10, so the display main body 10 can be operated without a specific power or a battery of the display main body 10 may be charged.

Obviously, in order to stop the rotation function of the display unit 12, the user can stop the display unit 12 from rotating by separating the rotary weight 25 or operating the stopper on the rotary unit 20 or the rotary base 30.

The present invention is not limited to the exemplary embodiments described above and defined by claims, and it is apparent to those skilled in the art that the present invention may be modified in various ways without departing from the scope of the present invention described in claims.

For example, as shown in FIG. 10, the rotary unit 20 may not be provided and the display main body 10 may be formed such that the center of gravity thereof is eccentric.

In this case, the center of gravity may be eccentric by coupling the rotary weight 25 directly to the display main body 10 or removing a portion of the display main body 10, and the rotary weight 25 may be disposed in the display main body 10.

Further, although a wristwatch of display devices was exemplified in the above embodiment, the display device having the rotatable display unit 12 of the present invention may be applied in the same structure to a table clock and a wall clock.

Obviously, the display main body 10 does not need to be limited to clocks and may be various devices having a display unit for showing information to a user such as a smart device supposed be put on a wrist or a smart phone.

Further, the display main body 10 is not limited to a circular shape and may be formed in various polygonal shapes.

The invention claimed is:

1. A display device having an automatically aligned display unit for displaying information, the display device comprising:

a base;

a display main body having the display unit for displaying information; and a rotary unit coupled to the display main body to rotate together and having a center of gravity that is eccentric from a center of the display main body, wherein the rotary unit and the display main body are rotatably mounted on the base to rotate together relative to the base to keep being aligned in a gravity direction by gravity applied to the rotary unit while the base does not rotate by the gravity, wherein a first bearing fitted around a rotary shaft is disposed between the display main body and the base, and wherein the first bearing is disposed in a space defined by a depression formed toward the display main body on the base, a cover detachably coupled to the base, and the rotary shaft.

2. The display device of claim 1, wherein an eccentric hole is formed through the rotary unit at an eccentric position from the center of the display main body.

3. The display device of claim 1, wherein the rotary unit includes a rotary plate coupled to a rear side of the display main body and a rotary weight coupled to the rotary plate to be eccentric from a center of gravity of the display main body.

4. The display device of claim 1, wherein the base includes a base plate disposed on a rear side of the display main body and a side housing extending from an edge of the base plate and surrounding the rotary unit.

5. The display device of claim 1, wherein a stopper is formed on at least any one of the rotary unit, the display main body, and the base and stops rotation of the rotary unit and the display main body combined with the rotary unit.

6. The display device of claim 1, wherein the display main body, the rotary unit, or the base has the rotary shaft, the rotary shaft allows the display main body and the rotary unit to rotate together relative to the base, and the rotary unit and the display main body are rotated about the rotary shaft.

7. The display device of claim 6, wherein the rotary shaft has a body, and a head formed at an end of the body and having a lateral cross-section larger than that of the body, and the body and the head are covered with a cover detachably coupled to the base.

8. The display device of claim 1, wherein a second bearing having an inner race and an outer race is disposed between an outer circumferential surface of the display main body and an inner surface of a side housing of the base such that the inner race and the outer race are rotated in contact with the outer circumferential surface of the display main body and the inner surface of the side housing of the base, respectively, so that the display main body rotates relative to the base.

9. The display device of claim 1, wherein a power generator is disposed around the rotary shaft between the display main body and the base and generates electricity from rotation of the rotary shaft.

10. The display device of claim 1, wherein a rotational rib and a rotational slot corresponding to each other are formed respectively on a side housing of the base and on an outer side, which is in contact with the side housing, of the rotary unit so that the base and the rotary unit are relatively rotated by the rotational rib and the rotational slot.

11. The display device of claim 3, wherein the rotary weight is detachably combined with the rotary unit.

12. A display device having an automatically aligned display unit for displaying information, the display device comprising:

a base; and a display main body having the display unit and a center of gravity eccentric from a center;

wherein the display main body is rotatably mounted on the base to rotate relative to the base to keep being aligned in a gravity direction by gravity applied to the display main body while the base does not rotate by the gravity, wherein a first bearing fitted around a rotary shaft is disposed between the display main body and the base, and wherein the first bearing is disposed in a space defined by a depression formed toward the display main body on the base, a cover detachably coupled to the base, and the rotary shaft.

13. The display device of claim 12, wherein a power generator is disposed around the rotary shaft to generate electricity from rotation of the rotary shaft.

14. The display device of claim 12, wherein a rotary weight is disposed on a side of the display main body eccentrically from a center of the display main body so that a center of gravity of the display main body is eccentric from the center of the display main body.

15. The display device of claim 13, wherein a storage unit is connected to the power generator and is disposed eccentrically from a center of the display main body so that a center of gravity of the display main body is eccentric from a center of the display main body.

16. The display device of claim 12, further comprising a second bearing having an inner race and an outer race, and disposed between an outer circumferential surface of the display main body and an inner surface of a side housing of the base such that the inner race and the outer race are rotated in contact with the outer circumferential surface of the display main body and the inner surface of the side housing of the base, respectively, so that the display main body rotates relative to the base.

17. The display device of claim 1, wherein the display unit includes an hour hand and a minute hand, or an electronic display for displaying time, and rotates together with the display main body by the gravity.

18. The display device of claim 12, wherein the display unit includes an hour hand and a minute hand, or an electronic display for displaying time, and rotates together with the display main body by the gravity.

* * * * *